US005921117A

United States Patent [19]

Illguth

[11] Patent Number: 5,921,117

[45] Date of Patent: Jul. 13, 1999

[54] MAILBOX LOCKING DEVICE

[76] Inventor: Frank J. Illguth, 266 4th Ave., Apt. 207, Salt Lake City, Utah 84103-2492

[21] Appl. No.: 09/004,719

[22] Filed: Jan. 9, 1998

[51] Int. Cl.[6] ..... E05B 55/00; E05C 1/02; G07G 1/00

[52] U.S. Cl. ..... 70/159; 70/150; 292/179; 292/150; 232/17; 232/41 D

[58] Field of Search ..... 232/17, 35, 36, 232/41 D; 220/315, 210, 8, 833–835; 292/179, 150, 266, 269; 70/159, 150

[56] References Cited

U.S. PATENT DOCUMENTS

| | | | |
|---|---|---|---|
| 4,382,540 | 5/1983 | Kelly et al. | 232/17 |
| 4,726,512 | 2/1988 | White | 232/17 |
| 4,815,656 | 3/1989 | Smith et al. | 232/34 |
| 5,082,169 | 1/1992 | Aurness et al. | 232/17 |
| 5,407,126 | 4/1995 | Coultas et al. | 232/17 |
| 5,476,220 | 12/1995 | Cohoon | 232/41 D |
| 5,586,718 | 12/1996 | Speece | 232/41 D |
| 5,645,215 | 7/1997 | Marendt et al. | 232/17 |
| 5,692,674 | 12/1997 | Wicker | 292/17 |

*Primary Examiner*—Steven Meyers
*Assistant Examiner*—Teri Pham
*Attorney, Agent, or Firm*—Mallinckrodt & Mallinckrodt

[57] ABSTRACT

A locking receptacle and a locking device for securing a mailbox, package delivery box, or other receptacle requiring a single opening of the receptacle door for a mailperson or package delivery person to insert a package being delivered and upon subsequent closing of the door locking until unlocked by a person having a key or combination therefor to receive the delivery. The locking device mounts to the inside of the receptacle and has an arm which is pivotally attached to the door of the receptacle and to a reciprocally pivotal locking disk. A first pivoting lever is positioned to engage a slot in the periphery of the locking disk when the door is closed so as to restrain the locking disk and the door in a closed position. A spring-biased, reciprocally pivotal counting disk is arranged to turn with the locking disk as the door is opened and to lock in that position by means of a second pivoting lever which engages a slot in the periphery of the counting disk. The first and second levers are interconnected such that the first lever will engage the slot in the locking disk when the door is closed only when the second lever is engaged in the slot in the counting disk. A key or combination type lock has a movable reset arm which when in the unlocked position contacts both levers to remove them from engagement with their respective slots to reset the locking device and upon moving to the locked position arms the locking device for subsequent single opening and closing operation of the receptacle door. Versions having linear acting locking and counting members are disclosed which operate similarly.

30 Claims, 7 Drawing Sheets

MAILBOX LOCKING DEVICE

BACKGROUND OF THE INVENTION

1. Field

The invention is in the field of locking mailboxes, package delivery boxes, and other such receptacles and locking devices therefor which allow a single opening of the receptacle door to insert a package then lock upon closing such that unlocking is needed to open the receptacle door.

2. State of the Art

There are a number of patents which disclose various locking mailboxes, locking package delivery boxes, locking receptacles for other goods, and locking devices for use therewith the purpose of which is to allow entry to the box or receptacle by the mailperson or other package delivery person and then to secure the item delivered by locking the box or receptacle.

U.S. Pat. No. 4,815,656 issued to Smith et al. discloses a combination mailbox locking device and mail indicator for use with a standard post-mounted mailbox. The device has a rotary disc with locking rim or flange at the edge thereof, a mail indicator rod attached to the disc for rotation therewith similar to a standard mailbox flag, and a key lock with a linear spring-loaded latch. The disc and rod interact with the latch such that a first rotary position indicates no mail to be picked up and the mailbox is not locked, and a second rotary position indicates to the mailperson there is mail to be picked up and that the mailbox is unlocked. The mailperson must insert the mail then rotate the rod to a third or locking position to engage the lock in a slot in the disc to lock the mailbox. A key must then be used to unlock the mailbox to remove the mail and the rod rotated to the first or second position to ready the mailbox for the next use.

U.S. Pat. No. 5,407,126 issued to Coultas et al. discloses a locking mailbox which has a spring-loaded catch member and a rotary key lock with a latch member. The catch member has a tapered end, a tapered retaining indent, and a non-tapered locking indent. The tapered end allows the latch member to seat in the retaining indent until the mailman unseats it by pulling the mailbox door open to deposit the mail, then closes it forcefully enough to seat the latch member in the locking indent wherein the mailbox door cannot be opened until a key is inserted into the lock and the latch member rotated out of the locking indent.

U.S. Pat. No. 4,382,540 issued to Kelly et al. discloses a mailbox having a front and a rear door, both of which are operated by a rotary key lock on the rear mailbox door. The device has a longitudinal sliding lock rod which is attached to a sliding cam having first and second ramps, which cam is disposed in a fixed mounting bracket adjacent the front door. The mounting bracket includes a fixed vertical portion. A U-shaped latch member is pivotally mounted at one end to the front door with a free end riding on the ramps of the cam. A magnet is attached to the inside top of the mailbox. The mechanism is set by unlocking the rotary key lock and opening the rear door. This allows the lock rod and the cam, by urging of the spring, to slide longitudinally to cause the free end of the latch to elevate along the second ramp so as to engage the magnet and to hold the free end in an elevated position relative to the cam. As the front door is opened, the latch member pulls free of the magnet such that upon closing of the front door the free end of the latch rides up the first ramp of the cam and engages the vertical portion of the mounting bracket to secure the front door in a closed position. An alternate embodiment is also disclosed which uses a pivoting cam in place of the sliding cam but the concept is the same.

U.S. Pat. No. 5,645,215 issued to Marendt et al. discloses a mailbox which has a key lock with a linear spring-loaded latch which key lock is mounted to the mailbox door and engages a fixed catch on the mailbox to hold the door in the locked position. The mailbox is operated by unlocking the key lock, opening the door, moving a sliding magnet forward toward the door, and gently closing the door until the door is held by the magnet but not by the latch. After the mailperson inserts the mail, the door must be closed with sufficient force to cause the latch to slide past the catch. The mailbox then cannot be opened until the lock in unlocked such that the latch is moved out of engagement with the catch member.

U.S. Pat. No. 4,726,512 issued to White discloses a locking device for use in a standard post-mounted mailbox which device forms an inner locking box within the mailbox. The inner box has a pivoting top which is contoured to fit against and be held to the inner surface of the mailbox top using a magnet and an inner front door which is held in an unlocked position against the mailbox door by a second magnet. A key operated spring latch is attached to the door of the inner box and engages a catch on the top of the inner box to lock the inner box. A spring-loaded release trigger mounted to the mailbox door has a wedge facing the inside of the mailbox when the outer door is closed. The mailbox must be set prior to mail delivery by moving the top of the inner box to the upper position against the magnet, pulling the spring-loaded latch with wedge to a non-operative position, and closing the mailbox door. Upon opening of the outer door of the mailbox the latch with wedge moves to an operative position such that upon closing of the outer door after inserting the mail, the wedge of the latch causes the contoured top to be moved away from the magnet and drop to the lowered position such that the latch secures the top and door of the locking box in the closed position. To remove the mail, the outer door must be opened and the key lock unlocked to open the inner box. An alternate embodiment is also disclosed which has a linear spring-loaded catch and a key lock with a linear spring-loaded latch. The catch is pulled laterally and the mailbox door closed such that the catch is held away from the locking position by contacting the side of the latch, until the mailbox door is opened wherein the catch moves to a locking position such that upon closing of the mailbox door the latch engages the catch to secure the mailbox door in the closed position until the lock is unlocked.

U.S. Pat. No. 5,082,169 issued to Aurness et al. discloses a two-door, door within a door, locking mailbox which requires the use of a special release tool carried by the mailperson to open the larger door and which utilizes a combination lock to secure the smaller door. A package indicator and a mail slot with a letter indicator are disclosed.

SUMMARY OF THE INVENTION

In accordance with the invention, a locking receptacle and a locking device for a receptacle which locking device mounts to the interior of the container portion of the receptacle and connects to the door thereof allows only a single opening of the door to place a package therein and locking upon closing of the door so as to secure the package therein. The locking device is accessible from the exterior of the receptacle for unlocking and preferably has a standard type rotary key lock which upon insertion of a key into the key lock and rotation thereof unlocks the door and resets the locking device. The mailperson need not carry a key to unlock the locking device which would put a burden on such mailperson if multiple mailboxes are on the delivery route other types of key locks such as those with a linearly moving latch and those using non-standard or custom designed keys such as rods and combination type locks may be used in the locking device.

The preferred embodiment of the locking device comprises a locking member and a counting member comprising a locking disk and a counting disk, respectively, which are rotationally mounted on a main post extending from a first base plate. A second base plate which is typically mounted to the interior of the receptacle container is held in a spaced-apart relationship with the first plate by a plurality of stand-offs. A locking arm is pivotally attached at one end to the locking disk and pivotally attached at a second end to the receptacle door such as by brackets attached to the door. The counting disk is spring-biased to a first or unlatched position and interconnected with the locking disk by means of a timing pin extending from the locking disk into a radial groove in the counting disk. As the door is opened the locking arm rotates the locking disk from a first or locking position to a second or unlocked position and the counting disk is rotated from the unlatched position to a second or latched position. The radial groove permits the locking disk to move back to the locking position as the door closes while the counting disk remains in the latched position.

Preferably a pair of levers are pivotally mounted to the first plate by means of an auxiliary post extending therefrom. The levers each have a locking protrusion extending from one end thereof and an aperture in the other end thereof. The levers are positioned such that the first or locking lever can engage a radially-extending slot at the periphery of the locking disk when the locking disk is in the locking position but only when in a latched mode wherein the second or counting lever engages a radially-extending slot at the periphery of the counting disk. When the counting lever is not engaging the slot at the periphery of the counting disk this is the unlatched mode wherein the locking lever cannot engage the slot in the periphery of the locking disk. An extension spring extends from the apertures of the respective levers to the base such as at one of the stand-offs so as to bias the respective locking protrusions of the levers toward the outer periphery of the respective disks. A bar affixed to the locking or counting lever contacts the other so as to not permit the locking lever to engage the slot in the periphery of the locking disk unless the counting lever is engaged in the slot in the periphery of the counting disk.

A lock, preferably a rotary key type lock, is attached through the first or second plate and has a key insertion aperture which is aligned with an aperture through the receptacle container to allow access to unlock the lock from outside of the receptacle. A reset arm is attached to the rotary lock which arm engages the apertured end of the locking and counting levers when the lock is in the unlocked position so as to disengage the protrusions of the respective levers from the slots in the periphery of the respective locking and counting disks so as to reset the locking device.

The locking device is armed for single opening operation of the door by resetting the locking device and moving the lock to the locked position with the receptacle door closed such that the locking disk is in the locking position and the counting disk biased by the extension spring is in the unlatched position wherein the locking protrusion of the counting lever contacts the outer periphery of the counting disk. In such unlatched mode, the bar prevents the locking protrusion of the locking lever from engaging the peripheral slot in the locking disk. As the receptacle door is opened such as to deposit mail or a package, the locking disk rotates to the unlocked position and moves the counting disk to the latched position wherein the locking protrusion of the counting lever engages the slot in the periphery of the counting disk. As the door is subsequently closed following deposit of mail or a package, the counting disk is retained in the latched position while the locking disk rotates back to the locking position. In such latching mode, when the locking disk reaches the locking position the locking protrusion of the locking lever engages the peripheral slot in the locking disk due to the urging of the respective biasing spring since the counting lever is engaged with the peripheral slot of the counting disk. The locking disk is retained in the locking position with the locking arm holding the receptacle door closed.

The preferred embodiment of the locking device is reset by inserting the key into the key lock and rotating the key such that the lock with reset arm rotate to the unlocked position wherein the reset arm engages both levers such that the locking protrusions of the respective levers are removed from engagement with the peripheral apertures in the respective locking and the counting disks. This permits the counting disk to rotate back to the unlatched position such that the counting lever contacts the periphery of the counting disk and the bar prevents the locking lever from engaging the peripheral slot in the locking disk such that the receptacle door can be opened. When the key is rotated to put the lock in the locked position the locking arm is removed from contact with the levers and the locking device is thus reset for a single opening and closing of the receptacle door prior to locking.

While the preferred embodiment of the locking device has disk shaped locking and counting members, the locking device can also be constructed using elongate generally straight bar or tubular locking and counting members in place of the locking and counting disks, which members are slidably disposed in relation to the base and which may be interconnected such as by a timing pin extending from the locking member into a generally straight elongate aperture in the counting member. The positions of the locking and counting members are analogous to those of the disk members and the levers engage a slot at the edge of the respective elongate member. The locking member can also be slidably disposed within a square or round cross-section tubular counting member which counting member is slidably disposed within a pivoting block. In such case, a spring-loaded pin fitting into apertures in the block, the counting member, and the locking member interact to provide the single opening function. The end of the locking member may be directly pivotally attached to the door without the use of a locking arm. In all cases, the base can be integral with or replaced by the structure of the container of the mailbox or other receptacle such that a separate base is not required.

The receptacle container and door can have widely varying shapes including containers having a varying number of sides, receptacles which are not fully enclosed by the container and door, doors hinged from varying sides of the container or slidably connected thereto rather than hingedly connected, and individual receptacles having multiple doors and locking devices. Likewise, the locking device base can be affixed to the door and the locking arm or locking member can be pivotally attached to the container of the receptacle.

Typical applications of the locking device include standard post-mounted individual mailboxes and other types of individual or grouped mailboxes, package delivery receptacles, milk delivery receptacles, and sliding drawer cabinets, though virtually any type of receptacle having one or more hinged or sliding doors may be constructed or the locking device used in conjunction therewith.

THE DRAWINGS

The best mode presently contemplated for carrying out the invention is illustrated in the accompanying drawings, in which:

FIG. 1 is a perspective view of a locking mailbox utilizing the locking device of the invention;

FIG. 2, an enlarged exploded perspective view of a portion of the locking device;

FIG. 2A, a view corresponding to FIG. 2 showing the remaining portion of the locking device;

FIG. 3, a perspective view of the locking device as reset and armed for operation;

FIG. 4, a perspective view of the locking device when the receptacle door is fully open;

FIG. 5, a perspective view of the locking device when the receptacle door is fully closed and locked;

FIG 6, a perspective view of the locking device in the initial position of the counting disk when being reset and armed;

FIG. 7, a perspective view of the locking device in the final position of the counting disk when being reset and armed.

FIG. 8, a perspective view of an alternate embodiment of the locking device as reset and armed for operation;

FIG. 9, an enlarged side elevation view of the spring pin in the compressed position;

FIG. 9A, view corresponding to FIG. 9 showing the spring pin in the extended position;

FIG. 10, a side elevational view of the alternate embodiment locking device when the receptacle door is open;

FIG. 11, a side elevational view of the alternate embodiment locking device when the receptacle door is closed and locked;

FIG. 12, a side elevational view of the alternate embodiment locking device in the initial position of the counting tube when being reset and armed;

FIG. 13, a side elevational view of the alternate embodiment locking device in the final position of the counting tube when being reset and armed.

DETAILED DESCRIPTION OF THE ILLUSTRATED EMBODIMENTS

Figure 1:
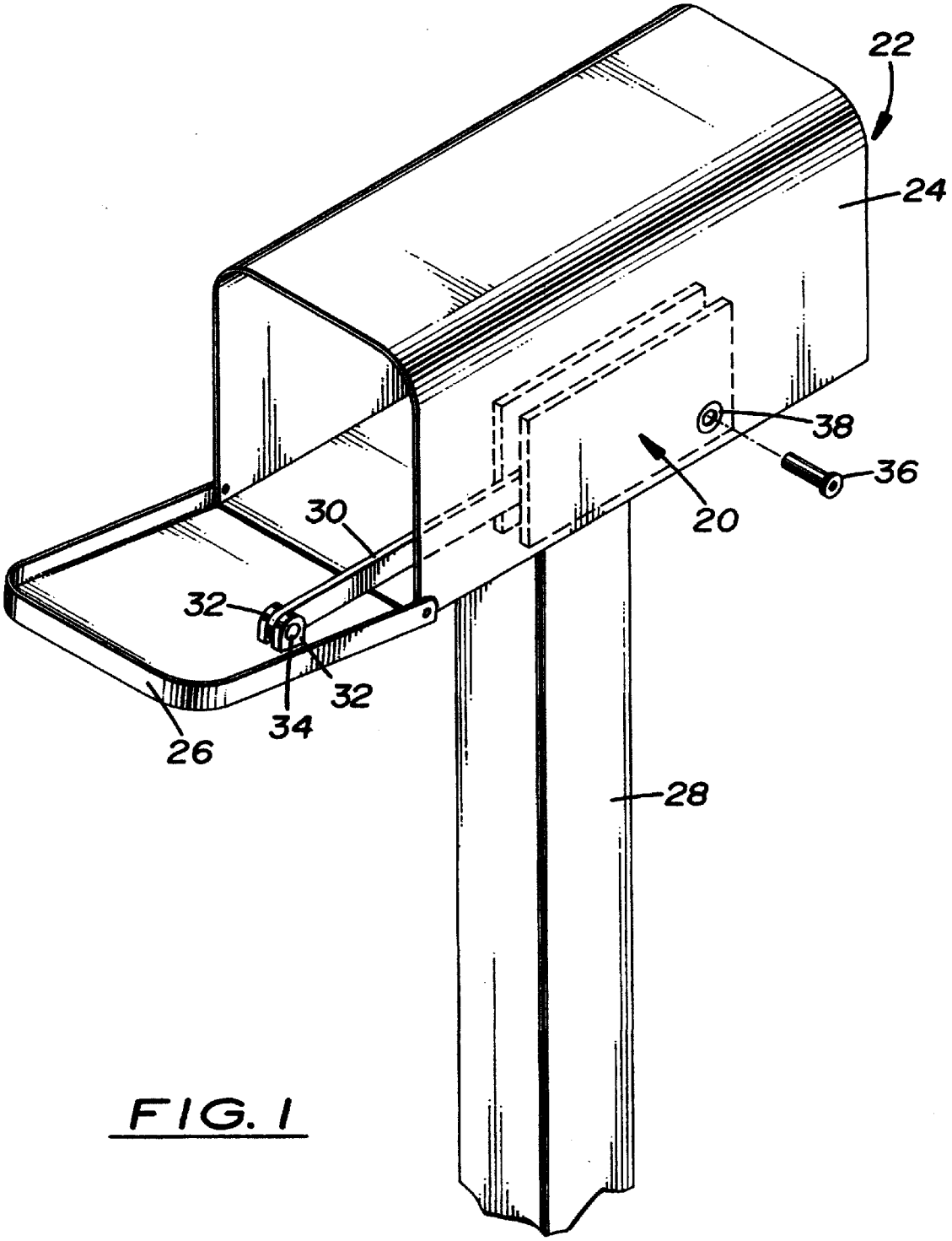

Referring to FIG. 1, the locking device 20 is shown installed in a typical receptacle such as mailbox 22 of the type having a container 24 and a hinged door 26 and mounted on a post 28. Locking device 20 attaches to the interior of container 24 such as by rivets or bolts (not shown) and has a locking arm 30 which pivotally attaches to door 26 by means such as a pair of brackets 32 and rivet or pin 34. A reinforcing plate (not shown) may be placed between door 26 and brackets 32 to reinforce door 26. Locking arm 30 moves with door 26 and retains door 26 in the closed position upon opening and closing thereof once wherein resetting locking device 20 must be unlocked and reset by inserting key 36 into key lock 38 and turning key 36.

Figures 2, 2A:
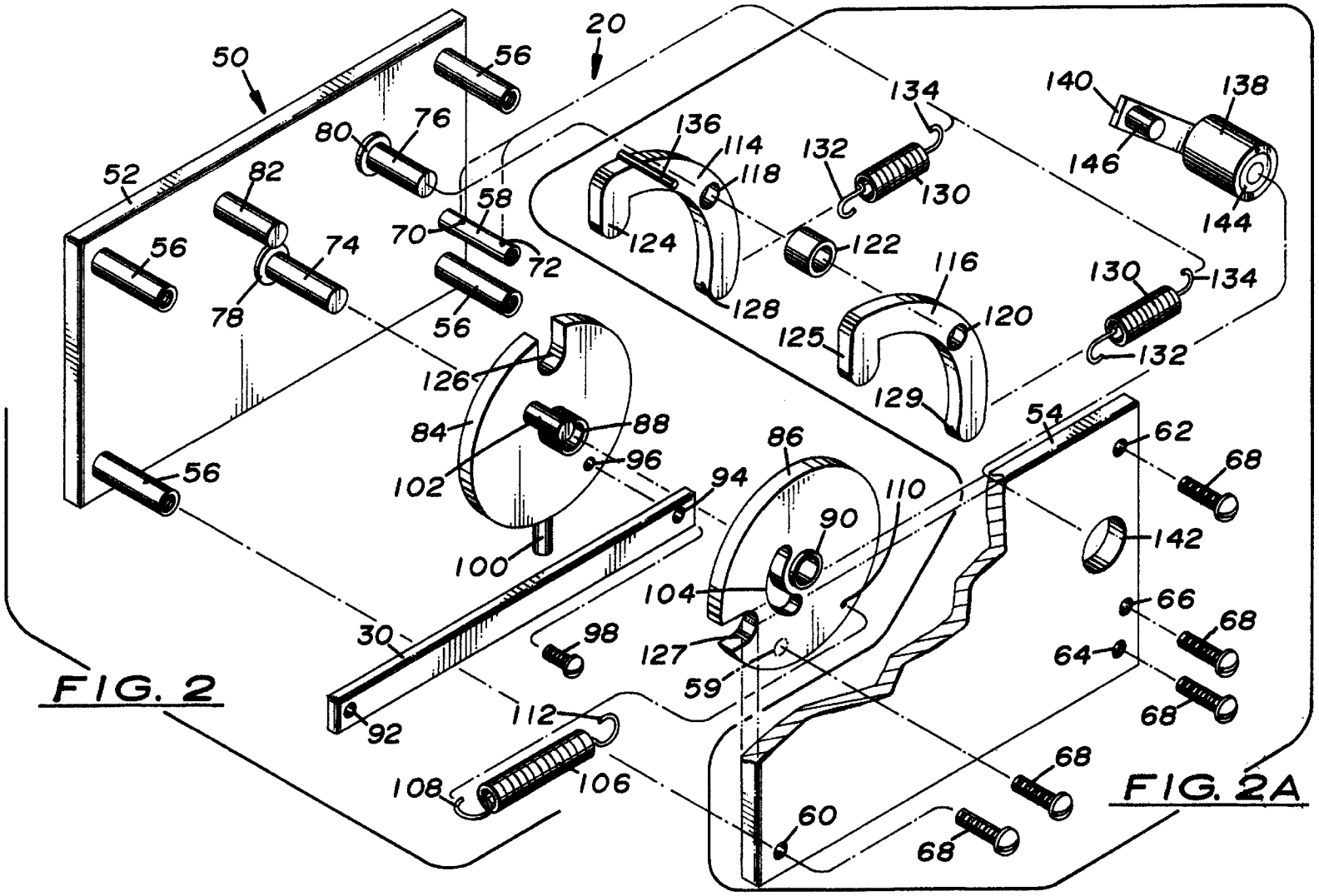

The inner workings of locking device 20 are best seen in the exploded views FIGS. 2 and 2A. Locking device 20 includes a base 50 having a first plate 52 and a second plate 54. Base 50 has a plurality of internally threaded stand-offs 56 and a stand-off 58 each of which may be integral with first plate 52 such as if first plate 52 and stand-offs 56 and 58 are injection molded plastic or cast metal, or may be separate pieces therefrom. Second plate 54 has a plurality of apertures 59, 60, 62, 64, and 66 of a smaller diameter than that the outer diameter of standoffs 56 and 58 and which align therewith and through which are disposed a plurality of screws 68 which hold first plate 52 with stand-offs 56 and 58 to second plate 54 to hold base 50 together. When stand-offs 56 and 58 are separate pieces from first plate 52 they can be internally threaded at both ends thereof with each having a corresponding aperture (not shown) in first plate 52 through which is disposed a screw 68 to retain them to first plate 52. Standoff 58 has a pair of apertures 70 and 72 laterally therethrough. A main post 74 and an auxiliary post 76 extend from first plate 52 each of which may be integral with first plate 52 or which is affixed thereto such as by brazing, welding, or by pressfitting into apertures (not shown) in first plate 52 or in second plate 54. First plate 52 has raised bearing surfaces 78 and 80 and second plate 54 has corresponding bearing surfaces (not shown) coaxially disposed about each of main post 74 and auxiliary post 76. Main post 74 and auxiliary post 76 are of sufficient length so as to nearly touch the bearing surfaces (not shown) of second plate 54 when base 50 is assembled. A stop pin 82 which may be integral with first plate 52 or second plate 54 and which is affixed thereto such as by brazing, welding, or by pressfitting into an aperture (not shown) therein extends therefrom. Base 50 can be built into the structure of the mailbox or other container such that a separate base is not required and does not require flat plates be used as most any method of pivotally mounting locking disk 84, counting disk 86 to the receptacle container or door may be used. Likewise, a base having only a first or a second plate with or without a corresponding plate built into the container or door may be made.

A locking disk 84 and a counting disk 86 having hubs 88 and 90, respectively, are rotationally disposed on main post 74 between first and second plates 52 and 54. Outwardly facing ends of hubs 88 and 90 abut the respective bearing surfaces of first and second plates 52 and 54, while mutually confronting ends of hubs 88 and 90 abut. Locking arm 30 has an aperture 92 at one end thereof through which pin 34 is disposed so as to pivotally connect locking arm 30 to brackets 32 of door 26 and at the opposite end thereof has an aperture 94 (FIG. 1). Locking disk 84 has a threaded aperture 96 laterally therein and locking arm 30 is pivotally connected to locking disk 84 by means such as a screw 98 which extends through aperture 94 of locking arm 30 and which threads into threaded aperture 96. A locking pin 100 extends radially outward from the periphery of locking disk 84 and is affixed thereto such as by brazing, welding, or by pressfitting into an aperture (not shown) in the periphery of locking disk 84. Locking pin 100 is positioned relative to threaded aperture 96 such that when locking disk 84 is rotated such that door 26 is fully open that locking pin 100 contacts locking pin 82 so as to stop the rotation of locking disk 84 so as to limit the opening of door 26 and also to prevent locking disk 84 from going over center relative to locking disk 84 such that locking disk 84 rotates backwards upon the closing of the door 26.

Locking disk 84 and counting disk 86 are interconnected such as by a timing pin 102 which is affixed to locking disk 84 such as by brazing, welding, or by pressfitting into an aperture (not shown) in locking disk 84 and which slidably engages a radial groove 104 in counting member 86. Radial groove 104 typically allows about one hundred forty-five degrees of rotational movement of counting disk 86 relative to locking disk 84 though this rotational relationship may vary such as from about ninety degrees to over one hundred eighty degrees of rotation depending on the particular design of the locking device 20, receptacle 22, and brackets 32 (FIG. 1). Counting disk 86 is biased such as by a torsion spring (not shown) which engages second plate 54 and counting disk 86 or as shown by an extension spring 106 having a first end loop 108 which fits into an aperture 110 in counting disk 86 and a second end loop 112 which fits around one of stand-offs 56 such that timing pin 102 is biased to contact one end of radial slot 104.

A locking lever 114 and a counting lever 116 having pivot apertures 118 and 120, respectively, are pivotally disposed on auxiliary post 76 with a tubular spacer 122 therebetween so as to position locking lever 114 generally coplanar with locking disk 84 and counting lever 116 generally coplanar with counting disk 86. Each of locking lever 114 and 116 have a locking protrusion 124 and 125, respectively, at one end thereof which can engage a mating slot 126 and 127 in the periphery of locking disk 84 and counting disk 86 so as to rotationally lock the respective disk 84 or 86. At the opposite end from locking protrusions 124 and 125 of each of locking lever 114 and counting lever 116 is an aperture 128 and 129, respectively. A pair of extension springs 130, each have a first end loop 132 disposed in aperture 128 in locking lever 114 or aperture 129 in counting lever 116 and a second end loop 134 disposed in aperture 70 or 72 in stand-off 58 so as to bias locking protrusions 124 and 125 of locking lever 114 and counting lever 116, respectively, into the respective slot 126 of locking disk 84 and slot 127 of counting disk 86. Locking lever 114 has a bar 136 affixed thereto which extends over counting lever 116 such that locking lever 114 cannot pivot and allow protrusion 124 to enter slot 126 unless counting lever 116 is also pivoted such that protrusion 125 is engaging slot 127 of counting disk 86 or in the latching mode. Alternatively, bar 136 can be affixed to counting lever 116 and extend below locking lever 114. Bar 136 may also be attached to either end and the top or bottom of locking lever 114 or counting lever 116 to achieve the same result.

Locking device 20 is unlocked and reset by means of a rotary key lock 138 having a reset arm 140 and which extends through a locking aperture 142 in second plate 54 which closely fits key lock 138 to prevent rotation thereof and such that a key insertion hole 144 of rotary key lock 138 is accessible for insertion of the key (not shown). Key lock 138 is held to second plate 54 by conventional means such as by a nut (not shown) for a circular aperture 142 or a spring plate (not shown) for a non-circular aperture (not shown). Reset arm 140 has a reset pin 146 which upon insertion of the key and rotation thereof to move lock 138 to the unlocked position moves reset pin 146 into contact with locking lever 114 and counting lever 116. Since the contact occurs between the respective pivot aperture 118 or 120 and the respective spring aperture 128 or 129 each of locking lever 114 and counting lever 116 are pivoted about auxiliary post 76 so as to remove the locking protrusions 124 and 125 from the respective locking slot 126 and counting slot 127 and to reset the locking device. Upon rotating the key back to a locked position locking lever 114 and reset pin 146 are rotated such that reset pin 146 does not contact locking lever 114 and counting lever 116, both of which are biased by springs 130 toward the outer periphery of the respective locking disk 84 and counting disk 86. Alternate types of locks can be utilized and mounted such that a moving part thereof contacts locking and counting levers 114 and 116 so as to move the respective protrusions 124 and 125 from the respective slots 126 and 127 of locking disk 84 and counting disk 86. Likewise, alternate positions of the respective protrusions 124 and 125 and alternate positions of pivots 118 and 120 of locking lever 114 and counting lever 116, respectively, may be used to achieve the same results to reset locking device 20.

Figure 3:
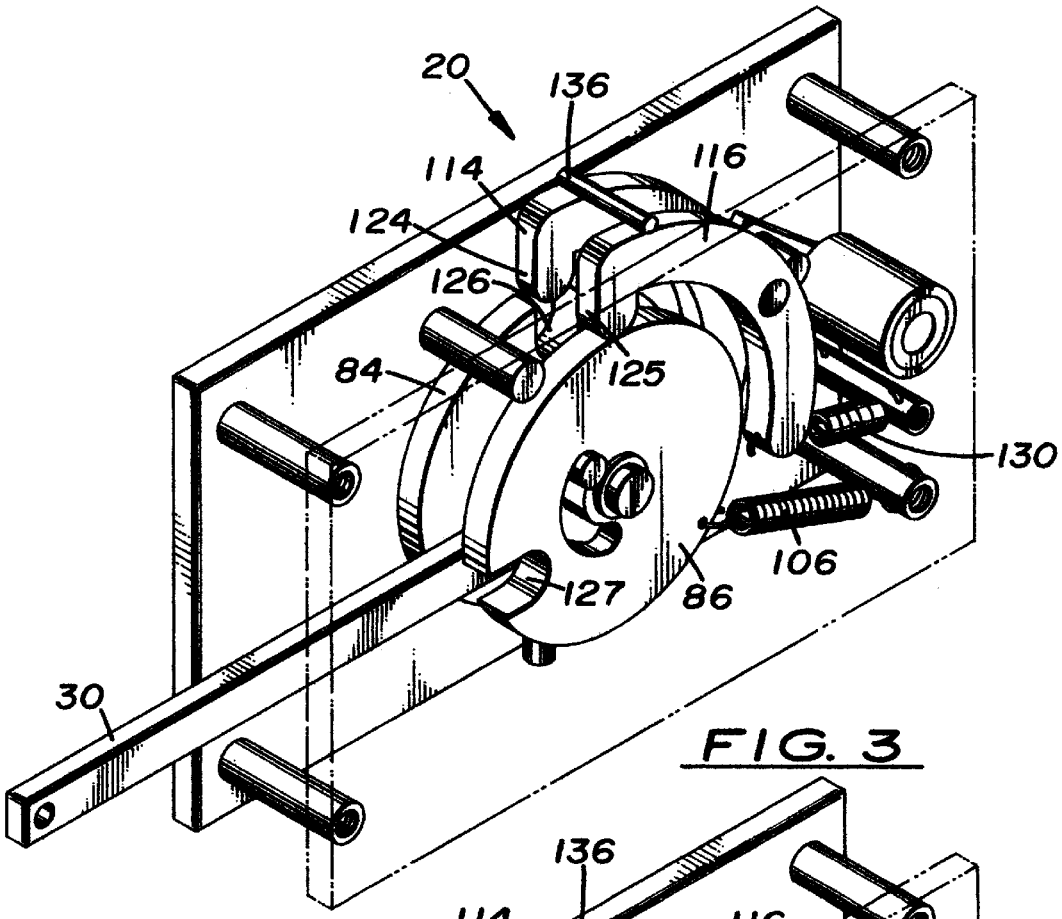

Referring to FIG. 3, the locking device 20 is shown in the reset and armed condition wherein the receptacle door (not shown) is closed with locking arm 30 retaining locking disk 84 in the locking position with counting disk 86 biased to the unlatched position by extension spring 106. Slot 127 in the periphery of counting disk 86 is oriented away from locking protrusion 125 of counting lever 116 and locking protrusion 125 of counting lever 116 is urged into contact with the periphery of counting disk 86 by one of extension springs 130. While slot 126 in the periphery of locking disk 84 is positioned to engage locking protrusion 124 of locking lever 114, such engagement does not occur due to bar 136 preventing such engagement by contacting counting lever 116, the locking protrusion 125 of which is not in engagement with slot 127 in the periphery of counting disk 86 and thus locking disk 84 is free to rotate and the receptacle door (not shown) is free to open, for the unlatched mode.

Figure 4:
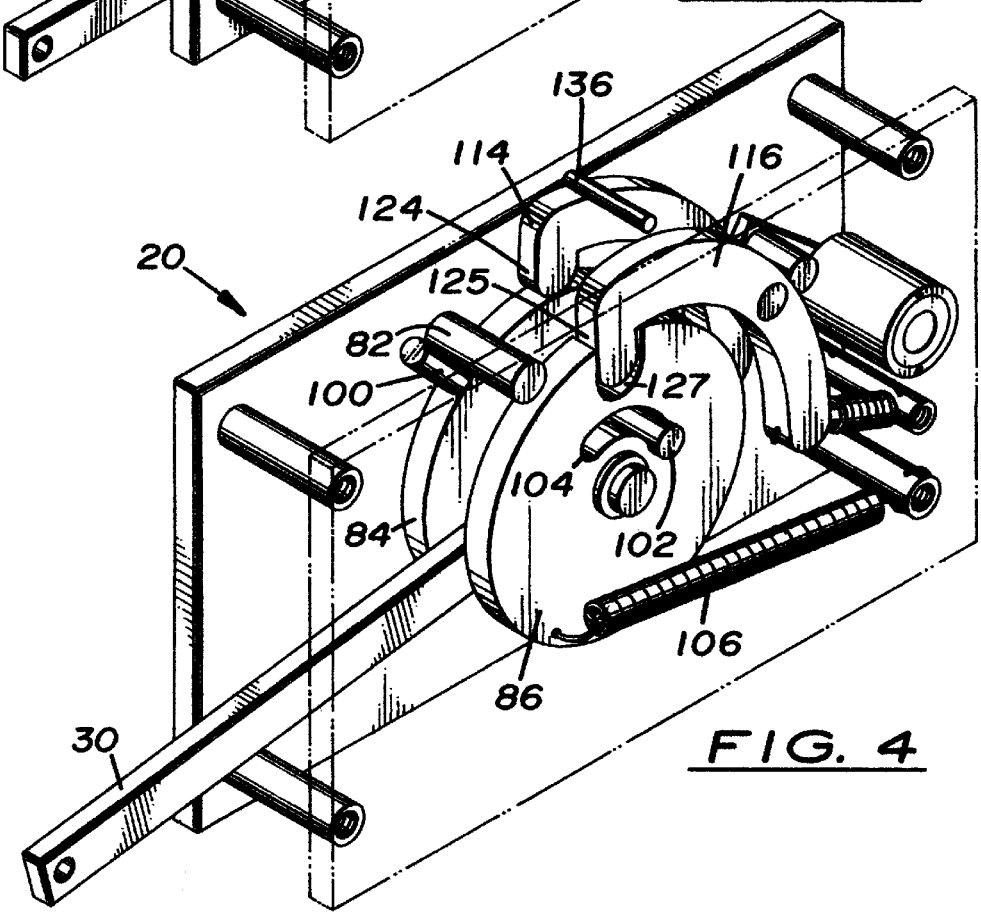

Referring to FIG. 4, as the receptacle door (not shown) is opened such as to deposit mail or a package, locking arm 30 rotates locking disk 84 until pin 100 contacts pin 82 wherein the receptacle door is fully open and cannot be opened further. As locking disk 84 is rotated counting disk 86 is rotated against the biasing of extension spring 106 by means of timing pin 102 engaging the end of radial slot 104. At the point wherein the receptacle door is fully open, locking protrusion 125 of counting lever 116 engages peripheral slot 127 of counting disk 86 for the latching mode.

Figure 5:
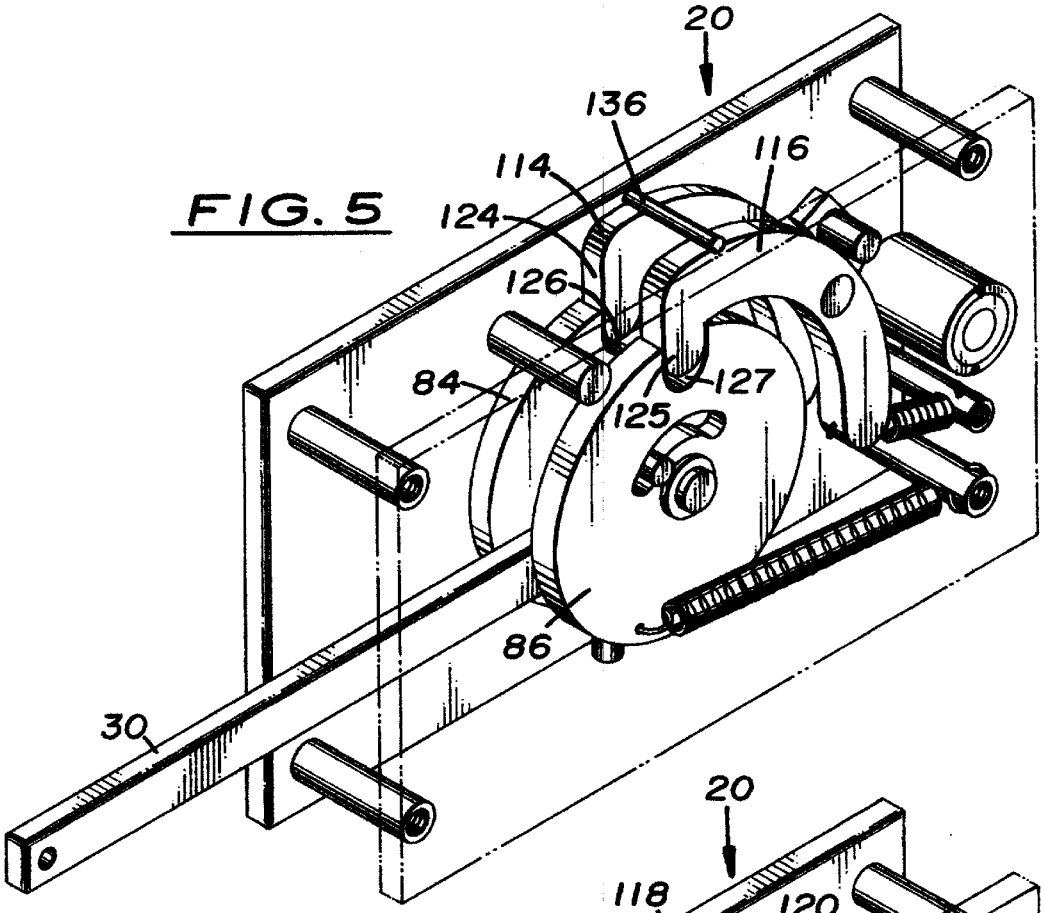

Referring to FIG. 5, therein is illustrated locking device 20 after the receptacle door (not shown) is again closed such that locking arm 30 returns locking disk 84 to the locking position of FIG. 3, except that locking protrusion 125 of counting lever 116 is in engagement with slot 127 in the periphery of counting disk 86. Bar 136 affixed to locking lever 114 does not prevent locking protrusion 124 thereof from entering slot 126 in the periphery of counting disk 84 such that the door is retained in the closed position.

Figure 6:
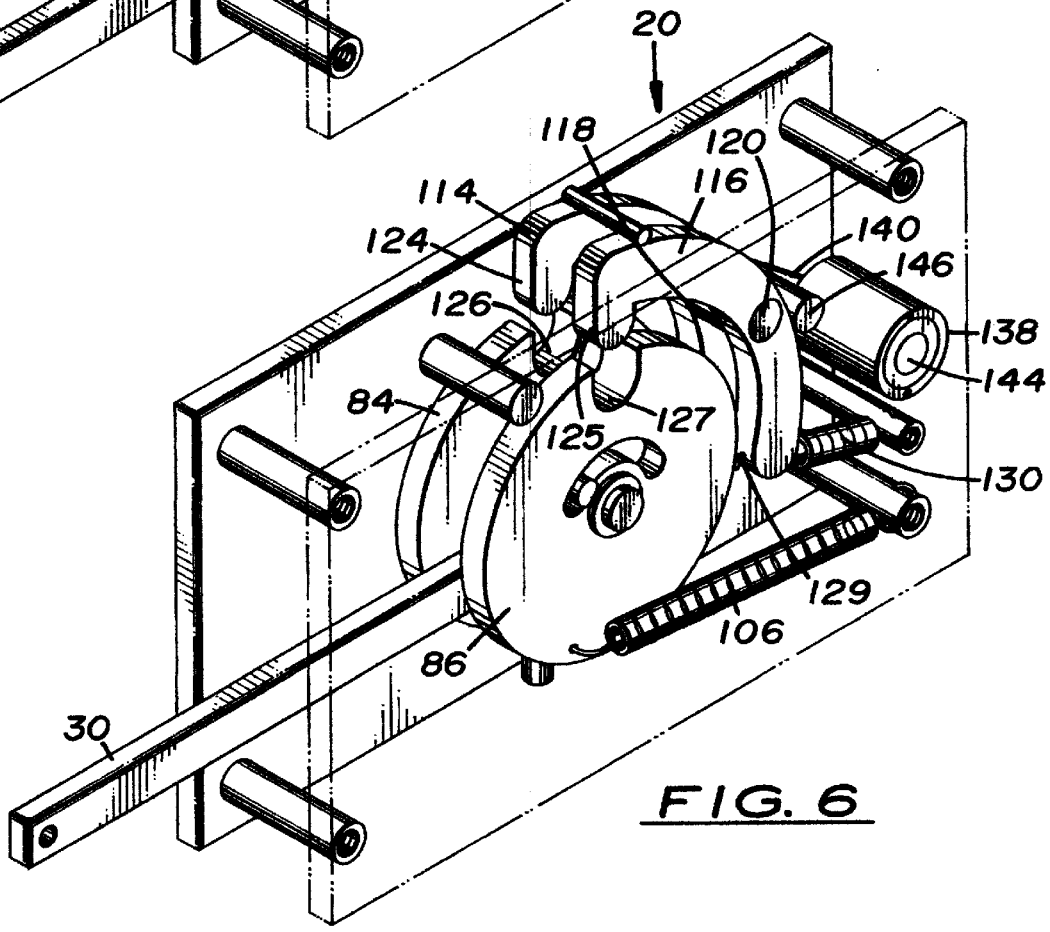
Figure 7:
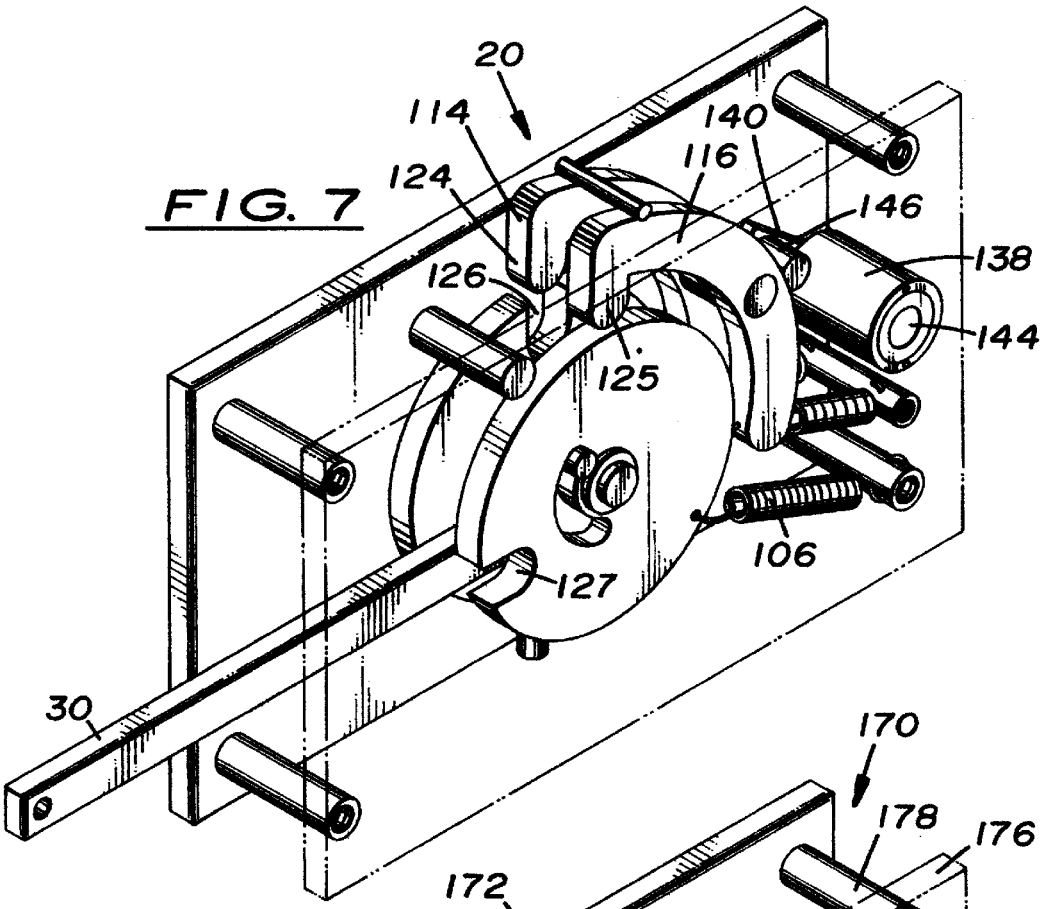

Referring to FIGS. 6 and 7, locking device 20 is unlocked and reset by inserting a key (not shown) into slot 144 of key lock 138 and rotating key 138 so as to rotate reset pin 146 of reset arm 140 into contact with locking lever 114 and counting lever 116 to remove locking protrusions 124 and 125 of locking lever 114 and counting lever 116, respectively, from the respective apertures 126 and 127 in the peripheries of locking disk 84 and counting disk 86, respectively. At the instant of release counting disk 86 is in the position shown in FIG. 6 but rotates quickly under the bias of extension spring 106 to the position shown in FIG. 7. Rotating the key back to the locked position in key lock 138 rotates reset arm 140 such that reset pin 146 does not contact locking lever 114 and counting lever 116 such that locking device 20 is reset and armed for one opening and closing operation.

Figure 8:
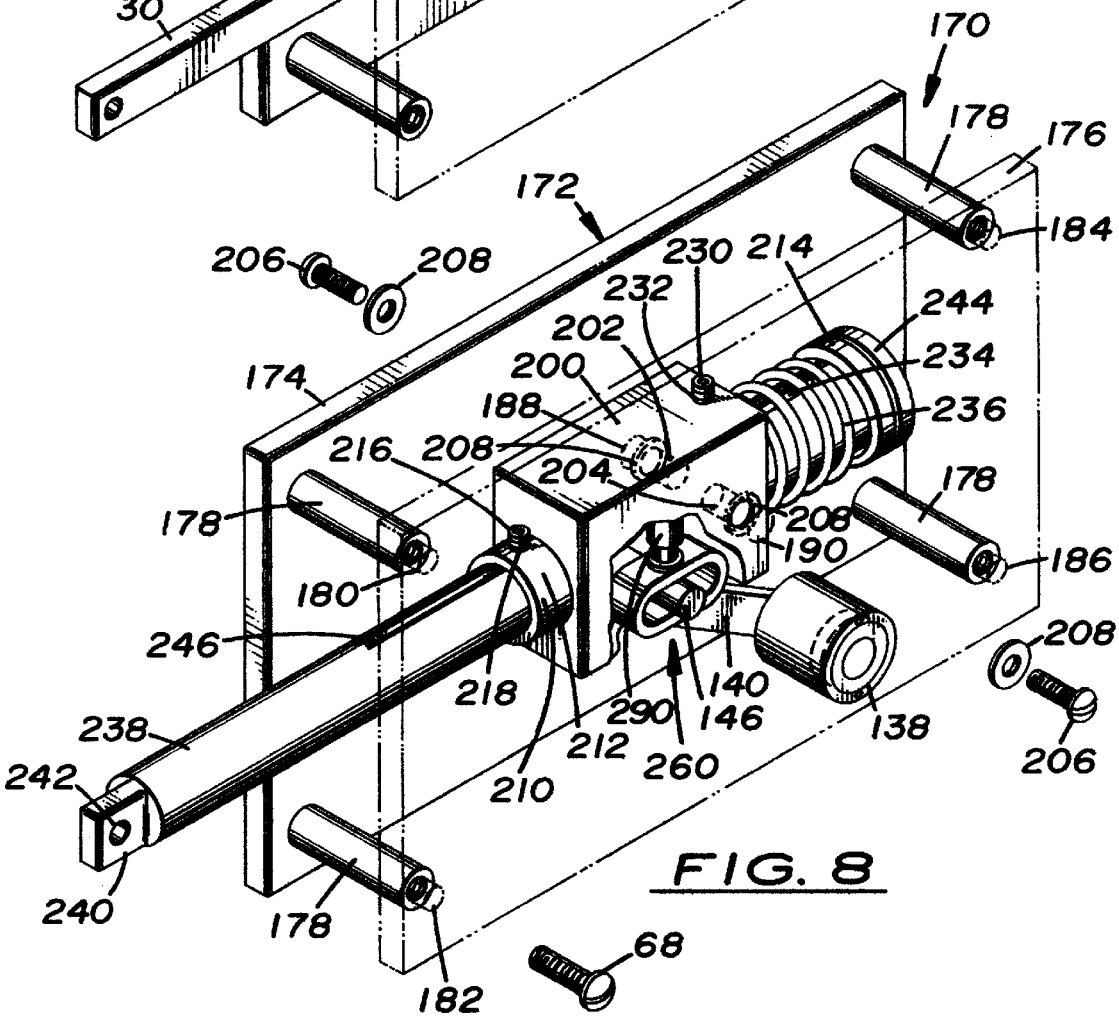

Referring to FIG. 8, therein is shown an alternate embodiment locking device 170 in the reset and armed position which locking device 170 includes a base 172 having a first plate 174 and a second plate 176. Base 172 has a plurality of internally threaded stand-offs 178 which may be integral with first plate 174 such as if first plate 174 and stand-offs 178 are injection molded plastic or cast metal, or may be separate pieces therefrom. Second plate 176 has a plurality of apertures 180, 182, 184, and 186 of a smaller diameter than that the outer diameter of standoffs 178 which align therewith and through which are disposed a plurality of screws 68 which hold first plate 174 with stand-offs 178 to second plate 176 to hold base 172 together. When stand-offs 178 are separate pieces from first plate 174 they can be internally threaded at both ends thereof with each having a corresponding aperture (not shown) in first plate 174 through which is disposed a screw 68 to retain them to first plate 174. A pair of pivot apertures 188 and 190 extend through first and second plates 174 and 176, respectively. Base 172 can be built into the structure of the mailbox or other container such that some or all of base plates 174, 176, and stand-offs 178 are not required, or are built into the container or door thereof.

Base 172 further includes a main block 200 having a pair of threaded pivot apertures 202 and 204 therein which align with pivot apertures 188 and 190 of plates 174 and 176, respectively, with main block 200 pivotally connected to plates 174 and 176 by means such as screws 206 and washers 208. Main block 200 can also be configured as a pair of separate spaced apart guide plates (not shown) affixed to base plates 174 and 176 or the container 22 or receptacle door 26 (FIG. 1) which plates guide counting tube 210. In the case of separate guide plates an idler arm (not shown) may be pivotally attached to locking rod 238 and to the brackets 32 (FIG. 1) on the door so as to allow pivotal movement between door 26 and locking rod 238.

A counting tube 210 is slidably disposed through an aperture 212 extending through main block 200. The sliding movement of counting tube 210 is restrained at one end by an integral spring seat 214 and at the opposite end by a set screw 216 within a threaded aperture 218 of counting tube 210 and which extends outward therefrom. Counting tube 210 is rotationally constrained by means of a set screw 230 disposed in a threaded aperture 232 which extends into main block 200 through to aperture 212 thereof and extending slidably into a matching longitudinal groove 234 in counting tube 210. Counting tube 210 is biased such as by a compression spring 236 such that set screw 216 abuts main block 200.

A locking rod 238 having at one end a flattened end 240 with an aperture 242 therethrough and at the opposite end thereof an integral stop 244 extends through counting tube 210. Pin 34 is disposed in aperture 242 so as to pivotally connect locking arm 30 directly to brackets 34 of door 26 rather than using locking arm 30 (FIG. 1). Locking rod 210 is rotationally constrained and longitudinally constrained in the direction of flattened end 240 by means of set screw 216 extending slidably into a matching longitudinal groove 246 in locking rod 238.

Figure 9:
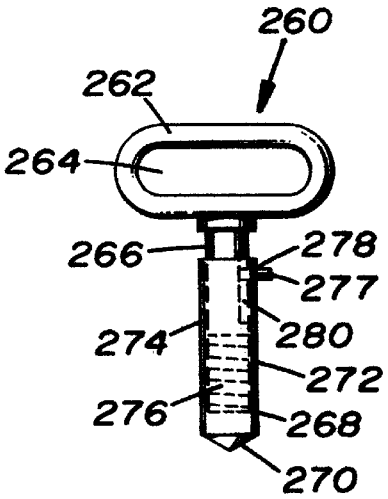
Figure 9A:
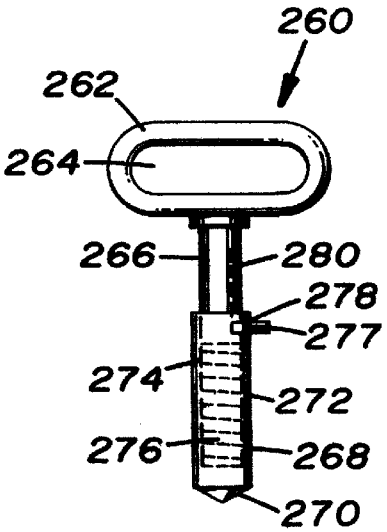

Referring to FIGS. 9 and 9A, therein is shown a spring pin 260 in a retracted position 9 and in an extended position 9A which spring pin 260 includes a body 262 having an oval aperture 264 therein and a rod 266 extending therefrom. Oval aperture 264 allows pin 146 of locking arm 140 to move laterally as key lock 138 moves from the locked position to the unlocked position and back. A plunger 268 has a point 270 and a body 272 having an aperture 274 extending most of the length thereof and sized to allow rod 266 to closely fit therein. A compression spring 276 fits within aperture 274 of plunger 268 and when rod 266 is inserted therein biases plunger 268 away from body 262. A set screw 277 disposed in a threaded aperture 278 of plunger 268 fits into a slot 280 in rod 266 extending from body 262 along most of the length thereof. Set screw 277 acts as a stop in conjunction with slot 280 to allow plunger 268 to slide relative to body 262.

Figure 10:
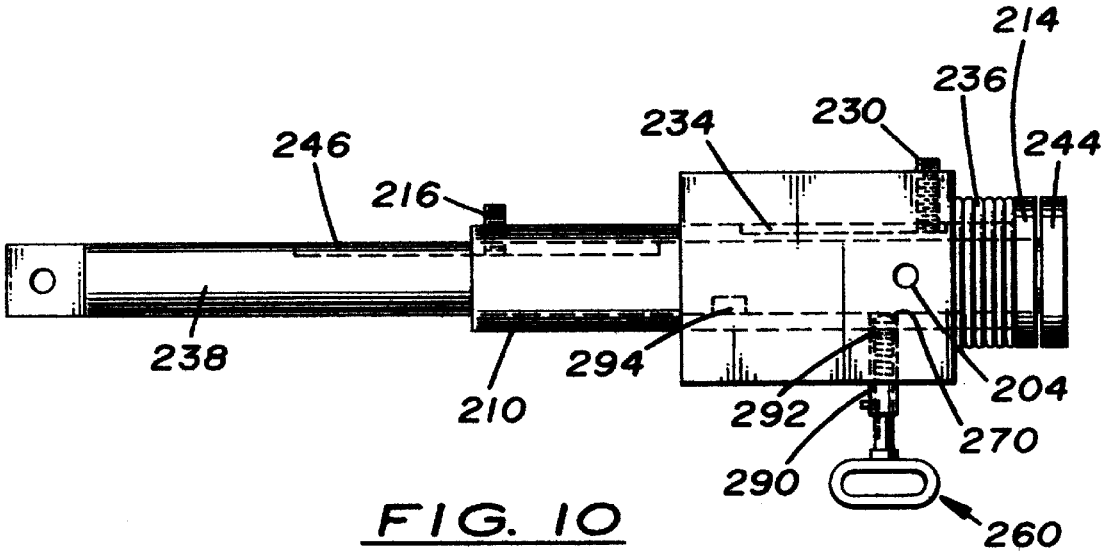
Figure 11:
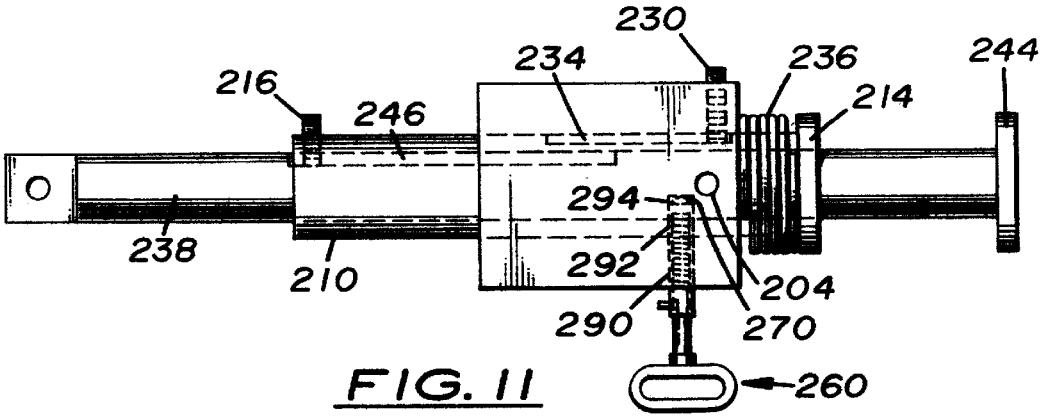

Referring to FIGS. 8 and 10, spring plunger 260 works in conjunction with main block 200 and rotary key lock 138 to control the motion of counting tube 210 and locking rod 238. Plunger 268 closely fits within an aperture 290 in main block 200 which extends through to aperture 212 thereof. Spring pin 260 is held in the locked position shown by means of rotary key lock 138 with reset pin 146 of reset arm 140 thereof disposed in aperture 264 of spring pin body 262. Rotary key lock 138 is disposed in an aperture 290 of second plate 176 and held thereto as previously described for the first embodiment locking device. Plunger 268 engages an aperture 292 in counting tube 210 when moved from the spring biased unlatched position (FIGS. 8 and 13) to the latching position (FIG. 10) so as to hold counting member 210 in the latching position. When plunger 268 is in engagement with aperture 292 in counting tube 210 and locking rod 238 is in the locking position an aperture 294 in locking rod 238 is engaged by plunger 268 so as to retain locking rod 238 and thus receptacle door 26 (not shown) attached thereto in the closed position (FIG. 11). Aperture 294 may also be an annular aperture or groove (not shown) in locking rod 238.

Figure 12:
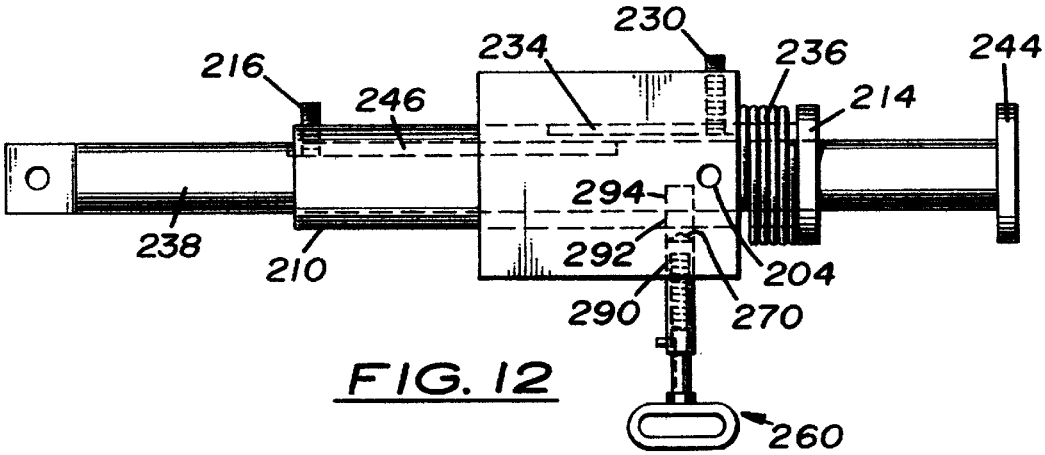
Figure 13:
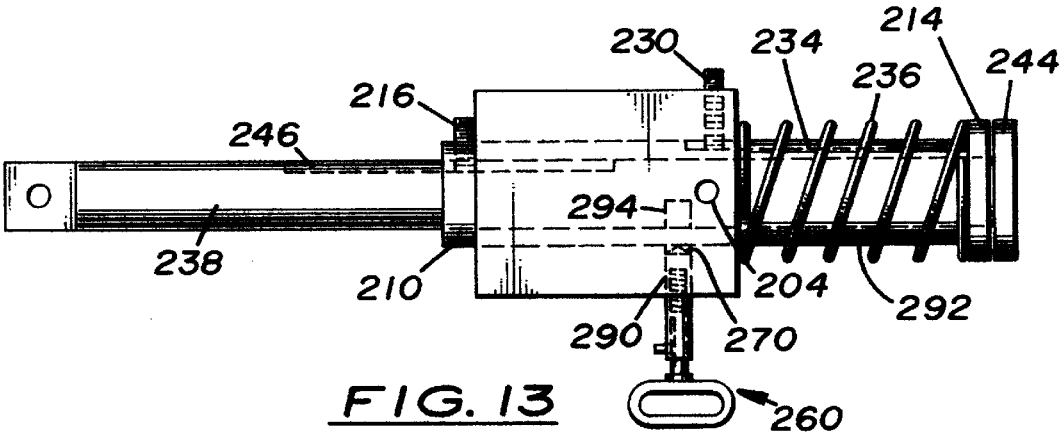

Locking device 170 can be reset by inserting the key (not shown) into key lock 138 and rotating it to the unlocked position wherein reset pin 146 moves spring pin 260 to the unlocked position (FIG. 12). In such unlocked position plunger tip 270 is removed from apertures 292 and 294 of counting tube 210 and locking rod 238, respectively, such that counting tube 210 moves to the unlatched position under the bias of compression spring 236 and locking rod 238 can move freely with the receptacle door. Upon rotating the key back to a locked position reset pin 146 moves spring pin 260 upward to the locked position wherein plunger tip 270 contacts the outer periphery of counting tube 210 since counting tube aperture 292 is not in alignment therewith and locking device 170 is reset for single door opening operation (FIG 13).

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A locking device for a receptacle of the type which has a container with a door movably connected thereto, which locking device permits the door to be opened and closed only once without subsequent unlocking, comprising:

a latching means having an unlatched mode wherein the door is free to move and a latched mode wherein upon closing, the door is secured by said latching means;

a counting means interconnected with said latching means wherein said counting means is normally biased to an unlatched position which precludes said latching means from being in the latching mode and a portion of which counting means is arranged to move with the door during opening thereof to the latched position and remain there such that said latching means is placed in the latching mode so as to secure the door upon closing of thereof; and locking means which can be unlocked from outside of the container having an unlocked position which resets the locking device by returning said counting means to the unlatched position and a locked position wherein the locking device is armed so as to allow only a single opening and closing of the door.

2. A locking device according to claim 1, further comprising:

a base adapted to mount to the inside of the container;

said latching means includes a locking member movably connected to said base and adapted to functionally connect to the door for reciprocal movement therewith from an unlocked position wherein said door is open to a locking position wherein the door is closed, and said latching means further includes locking member restraining means which when in the latching mode with said locking member in the locking position restrains said locking member from moving;

said counting means includes a counting member movably connected to said base for reciprocal motion, disposed generally parallel to said locking member, and biased to the unlatched position, which counting member further includes a counting member restraining means which interacts with said locking member restraining means so as to preclude the latching mode when said counting member is in the unlatched position and which permits the latching mode and restrains said counting member when said counting member is in the latched position; and wherein the locking means interacts with said locking and counting restraining means and when in the unlocked position releases said locking and counting members.

3. A locking device according to claim 2, wherein:

the locking member restraining means includes a locking lever movably connected to the base with a corresponding locking slot in the locking member being biased to and positioned such as to be engagable with said locking lever when said locking member is in the locking position; and the counting means restraining means includes a counting lever movably connected to the base with a corresponding counting slot in the counting member being biased to and positioned so as to engage said counting lever when said counting member is in the latched position.

4. A locking device according to claim 3, wherein:

the locking lever and the counting lever each have a locking protrusion adapted to engage the slot in the respective locking member and counting member with each lever being pivotally connected to the base at a pivot;

spring means attached to each of said locking and counting members and to said base which bias said locking and counting members such that the locking protrusions thereof engage the respective locking and counting slots;

spring means attached to said counting member and to said base biases said counting member to the unlatched position; and the counting member restraining means comprises a bar means affixed to one of said locking member and said counting member which extends to and contacts other of said locking member and said counting member when said locking protrusion of said counting lever is not engagement with said counting slot.

5. A locking device according to claim 4, wherein:

the locking member and the counting member are each generally flat circular disks having their respective locking and counting slots at the respective outer peripheries thereof and pivotally mounted to the base; and an elongate locking arm is pivotally connected to said locking member and pivotally connected to the door to functionally connect the same.

6. A locking device according to claim 5, wherein:

the base comprises a pair of spaced-apart generally parallel plates, at least one of which is adapted to attach to the inside of the container, and a plurality of spacers which are connected to each plate to hold said plates in the generally parallel spaced-apart relationship;

the locking and the counting members are generally parallel disposed and coaxially pivotally mounted between said plates by means of a post which extends through an aperture in the center of each of the respective locking and counting members and being affixed to at least one of said plates;

the locking and the counting levers are generally parallel disposed and pivotally mounted between said plates adjacent the outer periphery of said locking and counting members by means of a post which extends through an aperture in each of the respective locking and counting levers and being affixed to at least one of said plates;

the spring means which biases said counting member to the unlatched position comprises an extension spring connected at one end to said counting member and at the opposite end to said base;

the locking and counting levers each include a second end which extends from the pivot generally away from the ends having the locking protrusions;

the spring means which biases each of said locking and counting levers comprises a pair of extension springs, one attached to the respective said second ends of said locking and counting members;

said locking member is connected to said counting member by means of a pin extending laterally from said locking member which engages a radial groove in said counting member; and the locking means comprises a rotary key lock attached to said base and having a resetting arm attached thereto which rotates when moved from the locked position to the unlocked position into contact with the second end of the respective locking and counting levers so as to pivot said locking and counting levers to disengage the respective protrusions thereof from the respective locking and counting member slots and back to the locked position.

7. A locking device according to claim 3, wherein the locking member is connected to the counting member by means of a pin extending laterally from said locking member which engages a groove in said counting member.

8. A locking device according to claim 2, wherein;

the base includes a pivotable main block having a pin receiving aperture therein:

the counting member comprises an elongate counting tube slidably connected to said main block and having a pin receiving aperture therein adapted to coaxially align with the pin receiving aperture of said main block when in the latched position;

the locking member comprises an elongate locking bar slidably disposed within said counting tube and having a pin receiving aperture therein adapted to coaxially align with the pin receiving aperture of said main block when in the locking position;

the locking member and counting member restraining means comprise a spring pin having a spring-loaded end and a lock end; and wherein said spring-loaded end of said spring pin is slidably disposed within said pin receiving aperture of said main block with the lock end thereof connected to the locking means for movement between a locked position wherein said spring-loaded end of said spring pin is biased toward said counting tube so as to enter said pin receiving aperture of said counting tube in the latched position and also enter said pin receiving aperture of said locking rod if in the locking position.

9. A locking device according to claim 8, wherein:

the locking rod is circular in cross-section and includes a longitudinally extending slot at the outer periphery thereof:

the counting tube is circular in cross-section and includes a longitudinally extending slot at the outer periphery thereof:

a first keying means affixed in the main block engages the longitudinal slot of said counting tube to maintain said counting tube in a generally fixed rotational orientation relative to said main block;

a second keying means affixed in said counting tube engages the longitudinal slot of said locking rod to maintain said counting tube in a generally fixed rotational orientation relative to said counting member.

10. A locking device according to claim 9, wherein:

the first and second keying means are first and second set screws one being threadably disposed in a threaded aperture in the respective main block and counting tube, a portion of said second set screw extending beyond the outer periphery of said counting tube and contacting said main block when said counting tube is in the unlatched position to act as a stop for said counting tube;

said counting tube includes a spring seat at the end thereof opposite said second set screw;

a compression spring is disposed about the outer diameter of said counting tube with the ends thereof contacting said main block and said spring seat so as to bias said counting tube toward the unlatched position, with said spring in a fully compressed position acting as a stop for said counting tube in the latched position;

said locking rod includes a stop which limits the motion of said locking rod in the unlocked position;

the spring pin includes an oval aperture at the lock end of the spring pin; and the locking means comprises a rotary key lock having an attached arm with a pin, said pin being disposed in said oval aperture of said arm, said arm being rotatable between a locked position wherein said spring pin is moved toward said counting tube and an unlocked position wherein said spring pin is moved away from and out of engagement with said counting tube.

11. A locking device according to claim 1, wherein the locking means comprises a rotary key lock.

12. A locking device according to claim 1, wherein:

said latching means includes a locking member movably connected to the interior of the container and adapted to functionally connect to the door for reciprocal movement therewith from an unlocked position wherein the door is open to a locking position wherein the door is closed, and said latching means further includes locking member restraining means which when in the latching mode with said locking member in the locking position restrains said locking member from moving;

said counting means includes a counting member movably connected to the interior of the container for reciprocal motion, disposed generally parallel to said locking member, and biased to the unlatched position, which counting member further includes a counting member restraining means which interacts with said locking member restraining means so as to preclude the latching mode when said counting member is in the unlatched position and which permits the latching mode and restrains said counting member when said counting member is in the latched position; and wherein the locking means interacts with said locking and counting restraining means and when in the unlocked position releases said locking and counting members.

13. A locking device according to claim 12, wherein:

the locking member restraining means includes a locking lever movably connected to the interior of the container with a corresponding locking slot in the locking member positioned such as to be engagable with said locking lever when said locking member is in the locking position; and the counting means restraining means includes a counting lever movably connected to the interior of the container with a corresponding counting slot in the counting member being biased to and positioned so as to engage said counting lever when said counting member is in the latched position.

14. A locking device as in claim 13, wherein:

the locking lever and the counting lever each have a locking protrusion adapted to engage the slot in the respective locking member and counting member with each being pivotally connected to the container at a pivot;

spring means attached to each of said locking and counting members and to the interior of the container which bias said locking and counting members such that the locking protrusions thereof engage the respective locking and counting slots;

spring means attached to said counting member and to the interior of the container portion biases said counting member to the unlatched position; and the counting member restraining means comprises a bar means affixed to one of said locking member and said counting member which extends to and contacts other of said locking member and said counting member when said locking protrusion of said counting lever is not engagement with said counting slot.

15. A locking device according to claim 14, wherein:

the locking member and the counting member are each generally flat circular disks having their respective locking and counting slots at the outer peripheries thereof and pivotally mounted to the interior of the container; and an elongate locking arm is pivotally connected to said locking member and pivotally connected to the door to functionally connect the same.

16. A locking device according to claim 15, wherein:

the interior of the container comprises a pair of spaced-apart generally parallel plates and a plurality of spacers which are connected to each plate to hold said plates in the generally parallel spaced-apart relationship;

the locking and the counting members are generally parallel disposed and coaxially pivotally mounted between said plates by means of a post which extends through an aperture in the center of each of the respective locking and counting members and being affixed to at least one of said plates;

the spring means which biases said counting member to the unlatched position comprises an extension spring connected at one end to said counting member and at the opposite end to said container;

the locking and counting levers each include a second end which extends from the pivot generally away from the ends having the locking protrusions;

the spring means which biases each of said locking and counting levers comprises a pair of extension springs, one attached to the respective said second ends of said locking and counting members;

said locking member is connected to said counting member by means of a pin extending laterally from said locking member which engages a radial groove in said counting member; and the locking means comprises a rotary key lock attached to said container and having a resetting arm attached thereto which rotates when moved from the locked position to the unlocked position into contact with the second end of the respective locking and counting levers so as to pivot said locking and counting levers to disengage the respective protrusions thereof from the respective locking and counting member slots and back to the locked position.

17. A locking device according to claim 13, wherein the locking member is connected to the counting member by means of a pin extending laterally from said locking member which engages a groove in said counting member.

18. A locking device according to claim 12, further comprising:

a main block pivotally attached to the container and having a pin receiving aperture therein;

the counting member comprises an elongate counting tube slidably connected to said main block and having a pin receiving aperture therein adapted to coaxially align with the pin receiving aperture of said main block when in the latched position;

the locking member comprises an elongate locking bar slidably disposed within said counting tube and having a pin receiving aperture therein adapted to coaxially align with the pin receiving aperture of said main block when in the locking position;

the locking member and counting member restraining means comprise a spring pin having a spring-loaded end and a lock end; and wherein said spring-loaded end of said spring pin is slidably disposed within said pin receiving aperture of said main block with the lock end thereof connected to the locking means for movement between a locked position wherein said spring-loaded end of said spring pin is biased toward said counting tube so as to enter said pin receiving aperture of said counting tube in the latched position and also enter said pin receiving aperture of said locking rod if in the locking position.

19. A locking device according to claim 18, wherein:

the locking rod is circular in cross-section and includes a longitudinally extending slot at the outer periphery thereof:

the counting tube is circular in cross-section and includes a longitudinally extending slot at the outer periphery thereof:

a first keying means affixed in the main block engages the longitudinal slot of said counting tube to maintain said counting tube in a generally fixed rotational orientation relative to said main block;

a second keying means affixed in said counting tube engages the longitudinal slot of said locking rod to maintain said counting tube in a generally fixed rotational orientation relative to said counting member.

20. A locking device according to claim 19, wherein:

the first and second keying means are first and second set screws one being threadably disposed in a threaded aperture in the respective main block and counting tube, a portion of said second set screw extending beyond the outer periphery of said counting tube and contacting said main block when said counting tube is in the unlatched position to act as a stop for said counting tube;

said counting tube includes a spring seat at the end thereof opposite said second set screw;

a compression spring is disposed about the outer diameter of said counting tube with the ends thereof contacting said main block and said spring seat so as to bias said counting tube toward the unlatched position, with said spring in a fully compressed position acting as a stop for said counting tube in the latched position;

said locking rod includes a stop which limits the motion of said locking rod in the unlocked position;

the spring pin includes an oval aperture at the lock end of the spring pin; and the locking means comprises a rotary key lock having an attached arm with a pin, said pin being disposed in said oval aperture of said arm, said arm being rotatable between a locked position wherein said spring pin is moved toward said counting tube and an unlocked position wherein said spring pin is moved away from and out of engagement with said counting tube.

21. A locking receptacle which may be opened and closed only once without subsequent unlocking, comprising:

a container;

a door movably connected to said container;

a latching means having an unlatched mode wherein said door is free to move and a latched mode wherein upon closing, said door is secured by said latching means;

a counting means interconnected with said latching means wherein said counting means is normally biased to an unlatched position which precludes said latching means from being in the latching mode and a portion of which counting means is arranged to move with the door during opening thereof to the latched position and remain there such that said latching means is placed in the latching mode so as to secure the door upon closing of thereof; and locking means which can be unlocked from outside of the container having an unlocked position which resets the locking device by returning said counting means to the unlatched position and a locked position wherein the locking device is armed so as to allow only a single opening and closing of the door.

22. A locking receptacle according to claim 21, wherein:

said latching means includes a locking member movably connected to the interior of the container and adapted to functionally connect to the door for reciprocal movement therewith from an unlocked position wherein the door is open to a locking position wherein the door is closed, and said latching means further includes locking member restraining means which when in the latching mode with said locking member in the locking position restrains said locking member from moving;

said counting means includes a counting member movably connected to the interior of the container for reciprocal motion, disposed generally parallel to said locking member, and biased to the unlatched position, which counting member further includes a counting member restraining means which interacts with said locking member restraining means so as to preclude the latching mode when said counting member is in the unlatched position and which permits the latching mode and restrains said counting member when said counting member is in the latched position; and wherein the locking means interacts with said locking and counting restraining means and when in the unlocked position releases said locking and counting members.

23. A locking receptacle according to claim 22, wherein:

the locking member restraining means includes a locking lever movably connected to the interior of the container with a corresponding locking slot in the locking member positioned such as to be engagable with said locking lever when said locking member is in the locking position; and the counting means restraining means includes a counting lever movably connected to the interior of the container with a corresponding counting slot in the counting member being biased to and positioned so as to engage said counting lever when said counting member is in the latched position.

24. A locking receptacle according to claim 23, wherein:

the locking lever and the counting lever each have a locking protrusion adapted to engage the slot in the respective locking member and counting member with each being pivotally connected to the container at a pivot;

spring means attached to each of said locking and counting members and to the interior of the container which bias said locking and counting members such that the locking protrusions thereof engage the respective locking and counting slots;

spring means attached to said counting member and to the interior of the container portion biases said counting member to the unlatched position; and the counting member restraining means comprises a bar means affixed to one of said locking member and said counting member which extends to and contacts other of said locking member and said counting member when said locking protrusion of said counting lever is not engagement with said counting slot.

25. A locking receptacle according to claim 24, wherein:

the locking member and the counting member are each generally flat circular disks having their respective locking and counting slots at the outer peripheries thereof and pivotally mounted to the interior of the container; and an elongate locking arm is pivotally connected to said locking member and pivotally connected to the door to functionally connect the same.

26. A locking receptacle according to claim 25, wherein:

the interior of the container comprises a pair of spaced-apart generally parallel plates and a plurality of spacers which are connected to each plate to hold said plates in the generally parallel spaced-apart relationship;

the locking and the counting members are generally parallel disposed and coaxially pivotally mounted between said plates by means of a post which extends through an aperture in the center of each of the respective locking and counting members and being affixed to at least one of said plates;

the spring means which biases said counting member to the unlatched position comprises an extension spring connected at one end to said counting member and at the opposite end to said container;

the locking means comprises a rotary key lock attached to said container and having a resetting arm attached thereto which rotates when moved from the locked position to the unlocked position into contact with the second end of the respective locking and counting levers so as to pivot said locking and counting levers to disengage the respective protrusions thereof from the respective locking and counting member slots and back to the locked position.

27. A locking receptacle according to claim 23, wherein the locking member is connected to the counting member by means of a pin extending laterally from said locking member which engages a groove in said counting member.

28. A locking receptacle according to claim 22, further comprising:

a main block pivotally attached to the container and having a pin receiving aperture therein;

the counting member comprises an elongate counting tube slidably connected to said main block and having a pin receiving aperture therein adapted to coaxially align with the pin receiving aperture of said main block when in the latched position;

the locking member comprises an elongate locking bar slidably disposed within said counting tube and having a pin receiving aperture therein adapted to coaxially align with the pin receiving aperture of said main block when in the locking position;

the locking member and counting member restraining means comprise a spring pin having a spring-loaded end and a lock end; and wherein said spring-loaded end of said spring pin is slidably disposed within said pin receiving aperture of said main block with the lock end thereof connected to the locking means for movement between a locked position wherein said spring-loaded end of said spring pin is biased toward said counting tube so as to enter said pin receiving aperture of said counting tube in the latched position and also enter said pin receiving aperture of said locking rod if in the locking position.

29. A locking receptacle according to claim 28, wherein:

the locking rod is circular in cross-section and includes a longitudinally extending slot at the outer periphery thereof:

the counting tube is circular in cross-section and includes a longitudinally extending slot at the outer periphery thereof:

a first keying means affixed in the main block engages the longitudinal slot of said counting tube to maintain said counting tube in a generally fixed rotational orientation relative to said main block;

a second keying means affixed in said counting tube engages the longitudinal slot of said locking rod to maintain said counting tube in a generally fixed rotational orientation relative to said counting member.

30. A locking receptacle according to claim 29, wherein:

the first and second keying means are first and second set screws one being threadably disposed in a threaded aperture in the respective main block and counting tube, a portion of said second set screw extending beyond the outer periphery of said counting tube and contacting said main block when said counting tube is in the unlatched position to act as a stop for said counting tube;

said counting tube includes a spring seat at the end thereof opposite said second set screw;

a compression spring is disposed about the outer diameter of said counting tube with the ends thereof contacting said main block and said spring seat so as to bias said counting tube toward the unlatched position, with said spring in a fully compressed position acting as a stop for said counting tube in the latched position;

said locking rod includes a stop which limits the motion of said locking rod in the unlocked position;

the spring pin includes an oval aperture at the lock end of the spring pin; and the locking means comprises a rotary key lock having an attached arm with a pin, said pin being disposed in said oval aperture of said arm, said arm being rotatable between a locked position wherein said spring pin is moved toward said counting tube and an unlocked position wherein said spring pin is moved away from and out of engagement with said counting tube.

* * * * *